US011697981B2

(12) United States Patent
Krejci et al.

(10) Patent No.: US 11,697,981 B2
(45) Date of Patent: Jul. 11, 2023

(54) INLINE FRACTURING VALVE SYSTEMS AND METHODS

(71) Applicant: Cameron International Corporation, Houston, TX (US)

(72) Inventors: Michael Krejci, Houston, TX (US); Pheng Aun Soh, Singapore (SG); Stuart Robinson, Katy, TX (US); Edward L. Ganzinotti, III, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 17/149,393

(22) Filed: Jan. 14, 2021

(65) Prior Publication Data

US 2022/0220833 A1 Jul. 14, 2022

(51) Int. Cl.

| | |
|---|---|
| ***E21B 43/12*** | (2006.01) |
| ***E21B 34/02*** | (2006.01) |
| ***E21B 33/10*** | (2006.01) |
| ***E21B 43/26*** | (2006.01) |

(52) U.S. Cl.

CPC ..... *E21B 43/12* (2013.01); *E21B 33/10* (2013.01); *E21B 34/02* (2013.01); *E21B 43/26* (2013.01)

(58) Field of Classification Search

CPC ..... E21B 43/12; E21B 43/26; E21B 33/10; E21B 34/02

USPC ..... 166/308.1

See application file for complete search history.

(56) References Cited

U.S. PATENT DOCUMENTS

| | | | | |
|---|---|---|---|---|
| 7,156,120 | B2 | 1/2007 | Cherfane et al. | |
| 9,523,260 | B2 * | 12/2016 | Mailand | E21B 34/10 |
| 9,568,109 | B2 * | 2/2017 | McHugh | E21B 34/02 |
| 10,233,721 | B2 | 3/2019 | Hoang et al. | |
| 10,669,812 | B2 * | 6/2020 | Green | E21B 47/18 |
| 10,704,361 | B2 * | 7/2020 | Mailand | E21B 41/0078 |
| 2018/0163501 | A1 | 6/2018 | Guidry | |
| 2020/0032608 | A1 | 1/2020 | Christopherson et al. | |
| 2020/0032609 | A1 | 1/2020 | Guidry | |
| 2021/0033199 | A1 * | 2/2021 | Atencio | E21B 34/02 |

* cited by examiner

*Primary Examiner* — Matthew R Buck
*Assistant Examiner* — Patrick F Lambe
(74) *Attorney, Agent, or Firm* — Eubanks PLLC

(57) ABSTRACT

Fracturing systems with frac valves for controlling flow of fracturing fluid are provided. In one embodiment, a fracturing apparatus includes a frac valve having a housing with a bore to convey fracturing fluid, a seal disposed within the bore, and an actuator coupled to control movement of the seal. The actuator can be disposed within the bore so as to move the seal between a closed position in which the seal blocks fracturing fluid flow through the bore and an open position that allows fracturing fluid flow through the bore. Additional systems, devices, and methods for fracturing are also disclosed.

19 Claims, 10 Drawing Sheets

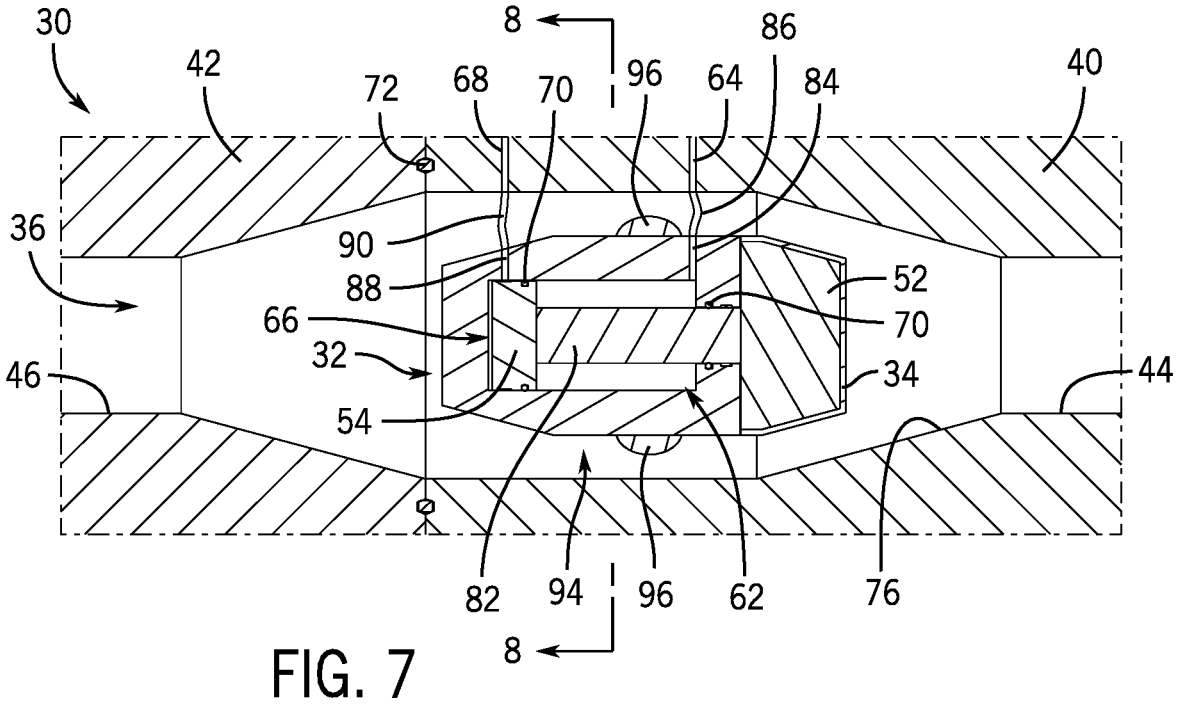
FIG. 7
FIG. 8
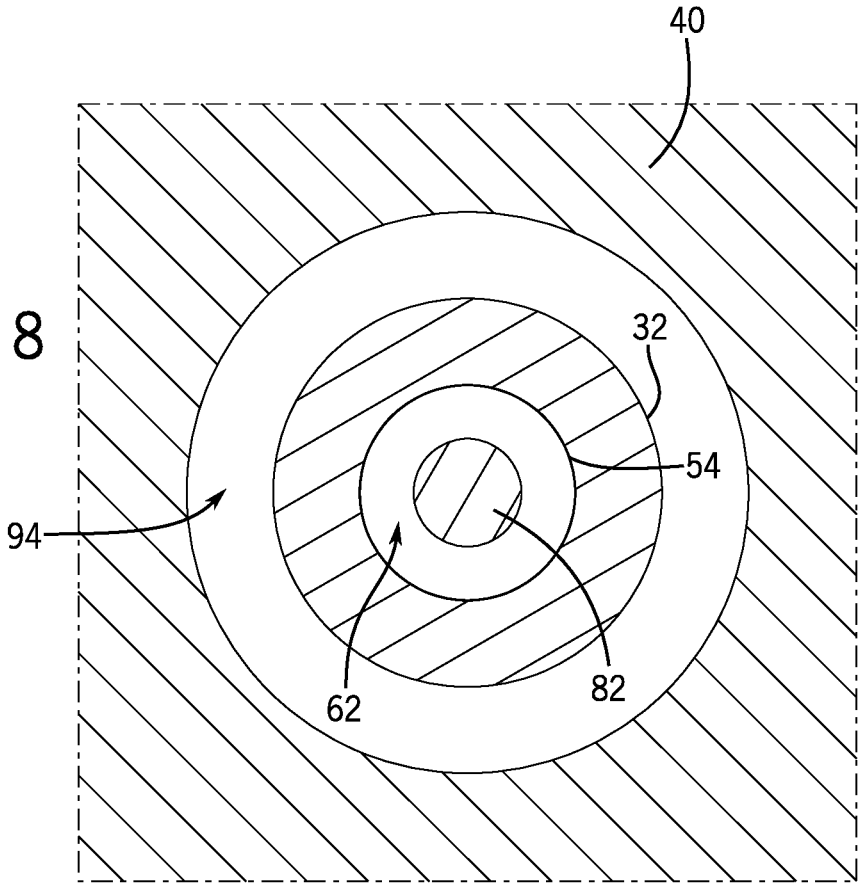

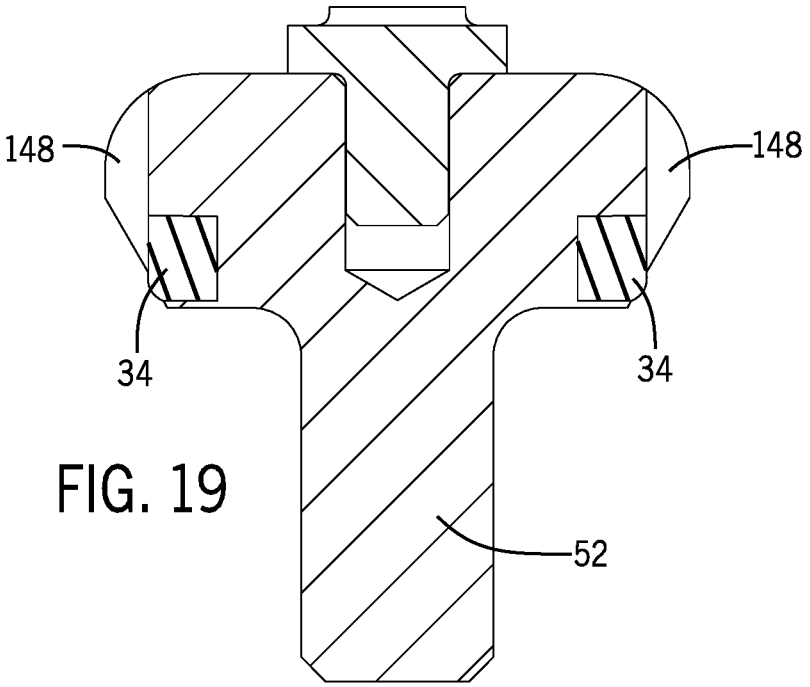
FIG. 19
FIG. 20
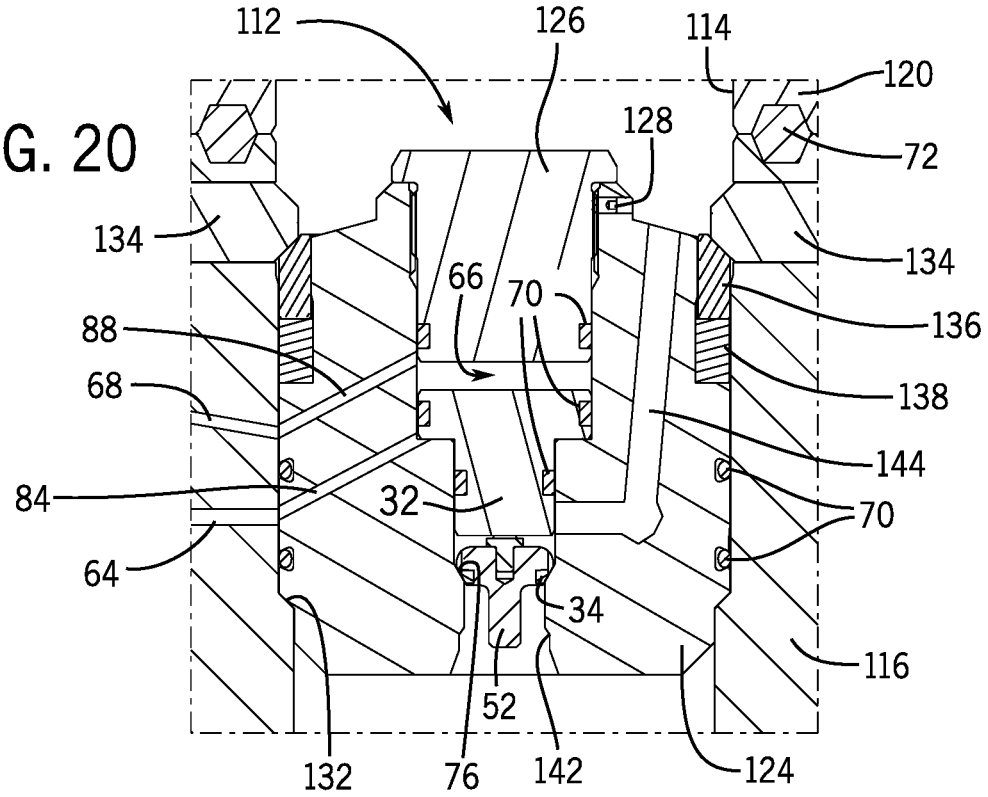

INLINE FRACTURING VALVE SYSTEMS AND METHODS

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling or extraction operations.

Additionally, such wellhead assemblies may use a fracturing tree and other components to facilitate a fracturing process and enhance production from a well. As will be appreciated, resources such as oil and natural gas are generally extracted from fissures or other cavities formed in various subterranean rock formations or strata. To facilitate extraction of such resources, a well may be subjected to a fracturing process that creates one or more man-made fractures in a rock formation. This facilitates, for example, coupling of pre-existing fissures and cavities, allowing oil, gas, or the like to flow into the wellbore. Such fracturing processes typically include injecting a fracturing fluid—which is often a mixture including proppant (e.g., sand) and water—into the well to increase the well's pressure and form the man-made fractures. The high pressure of the fluid increases crack size and crack propagation through the rock formation to release oil and gas, while the proppant prevents the cracks from closing once the fluid is depressurized. During fracturing operations, fracturing fluid may be routed via fracturing lines (e.g., pipes) to fracturing trees or other assemblies installed at wellheads. Conventional fracturing trees have valves that can be opened and closed to control flow of fluid through the fracturing trees into the wells.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to valves for controlling fluid flow. More specifically, some embodiments relate to frac valves for controlling the flow of fracturing fluid in fracturing systems. In some instances, the frac valves may be provided in a wellhead assembly (e.g., in a fracturing tree) or a fluid supply system (e.g., a fracturing manifold) to control the flow of fracturing fluid during fracturing operations at a wellsite. A frac valve may be provided as an inline frac valve having an actuator and seal that are positioned within a flow bore of the valve such that the actuator can move the seal between open and closed positions to control flow through the valve. In some embodiments, flow-by conduits in the actuator facilitate flow of fluid past the actuator within the flow bore when the valve is open.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein:

FIG. 7 is an axial cross-section of an inline frac valve having an actuator and seal installed within a flow bore of the valve, with the seal shown in an open position allowing flow through the valve, in accordance with one embodiment;

FIG. 8 is a radial cross-section of the valve of FIG. 7 showing an annular flow-by area surrounding the actuator in accordance with one embodiment;

FIG. 19 is a detail view of the seal and the seal carrier and generally depicts flow-by slots in the seal carrier that facilitate flow through the assembly when the seal and seal carrier are in the open position in accordance with one embodiment; and FIG. 20 is a detail view like that of FIG. 18 but with the actuator, seal carrier, and seal in a closed position that blocks flow through the assembly in accordance with one embodiment.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
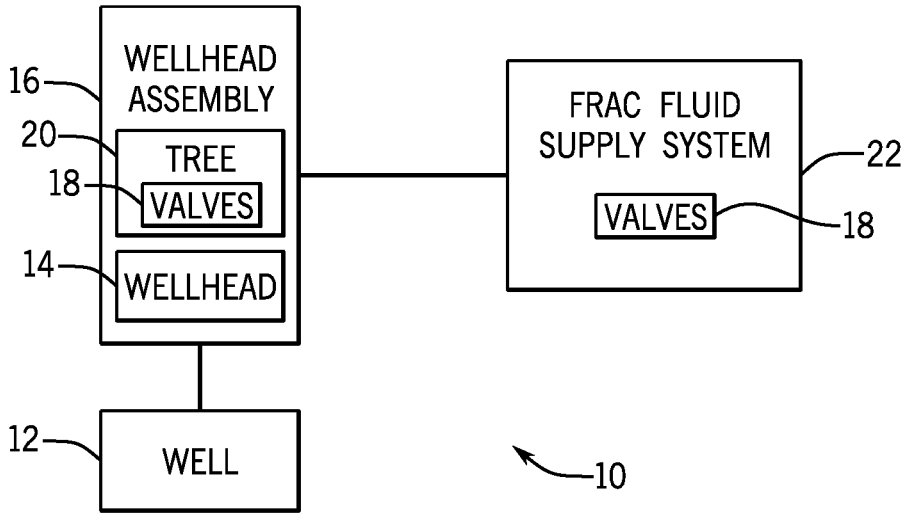
FIG. 1 generally depicts a fracturing system having valves for controlling flow in accordance with an embodiment of the present disclosure.

Turning now to the present figures, an example of a fracturing system 10 is provided in FIG. 1 in accordance with certain embodiments. The fracturing system 10 facilitates extraction of natural resources, such as oil or natural gas, from a subterranean formation via a well 12 and a wellhead 14. Particularly, by injecting a fracturing fluid into the well 12, the fracturing system 10 increases the number or size of fractures in a rock formation or strata to enhance recovery of natural resources present in the formation. Well 12 is a surface well in some embodiments, but it will be appreciated that resources may be extracted from other wells 12, such as platform or subsea wells.

The fracturing system 10 includes various components to control flow of a fracturing fluid into the well 12. For instance, the fracturing system 10 depicted in FIG. 1 includes a wellhead assembly 16 that receives fracturing fluid from a fluid supply system 22. In some embodiments, the wellhead assembly 16 includes one or more frac valves 18 to control flow of fracturing fluid into the well 12. More particularly, the wellhead assembly 16 can include a fracturing tree 20 having one or more frac valves 18. Various examples of frac valves are described below in accordance with the present techniques. In some embodiments, a fracturing tree 20 may include one or more of these frac valves to control flow of fracturing fluid through the tree 20 into the well 12 (or from the well 12 in some instances, such as during a flowback operation). Any of the described frac valves could be used as an upper master valve or a lower master valve of the fracturing tree 20, for instance. The sizes and pressure ratings of the frac valves 18 may vary depending on the intended application. But in at least some embodiments the frac valves 18 have large bores, such as a nominal bore diameter of seven and one-sixteenth inches (approximately 18 cm) and are constructed for high pressure applications, such as up to 15,000 psi (approximately 100,000 kPa). Those skilled in the art will appreciate that the fracturing tree 20 could include other elements, such as connection blocks, wing valves, a swab valve, and a frac head. In other embodiments, the wellhead assembly 16 may include one or more frac valves 18 without a fracturing tree mounted over the wellhead 14.

The fracturing fluid supply system 22 may also (or instead) include one or more frac valves 18 for controlling flow of fracturing fluid to the well 12. The frac valves 18 of the fracturing fluid supply system 22 may be provided in the form of a frac valve described below or in any other suitable form. In some embodiments, the fracturing fluid supply system 22 includes trucks that pump the fracturing fluid to the wellhead assembly 16, but any suitable sources of fracturing fluid and manners for transmitting such fluid to the wellhead assembly 16 may be used. In some instances, the fracturing fluid supply system 22 includes a fracturing manifold for distributing fracturing fluid to multiple wells 12 via respective wellhead assemblies 16. The fracturing manifold may include frac valves 18 to control flow of fracturing fluid to the individual wells 12.

In some embodiments, a frac valve 18 of the fracturing system 10 is embodied by one of the valves 30 described below. Various examples of valves 30 are described below as frac valves 30 for controlling flow of fracturing fluids. But it will be appreciated that the various valves 30 described herein could also or instead be used in other applications to convey other fluids. As described in greater detail below, the valves 30 can include inline actuators and seals positioned within flow paths of the valves to selectively control flow through the valves.

Figure 2:
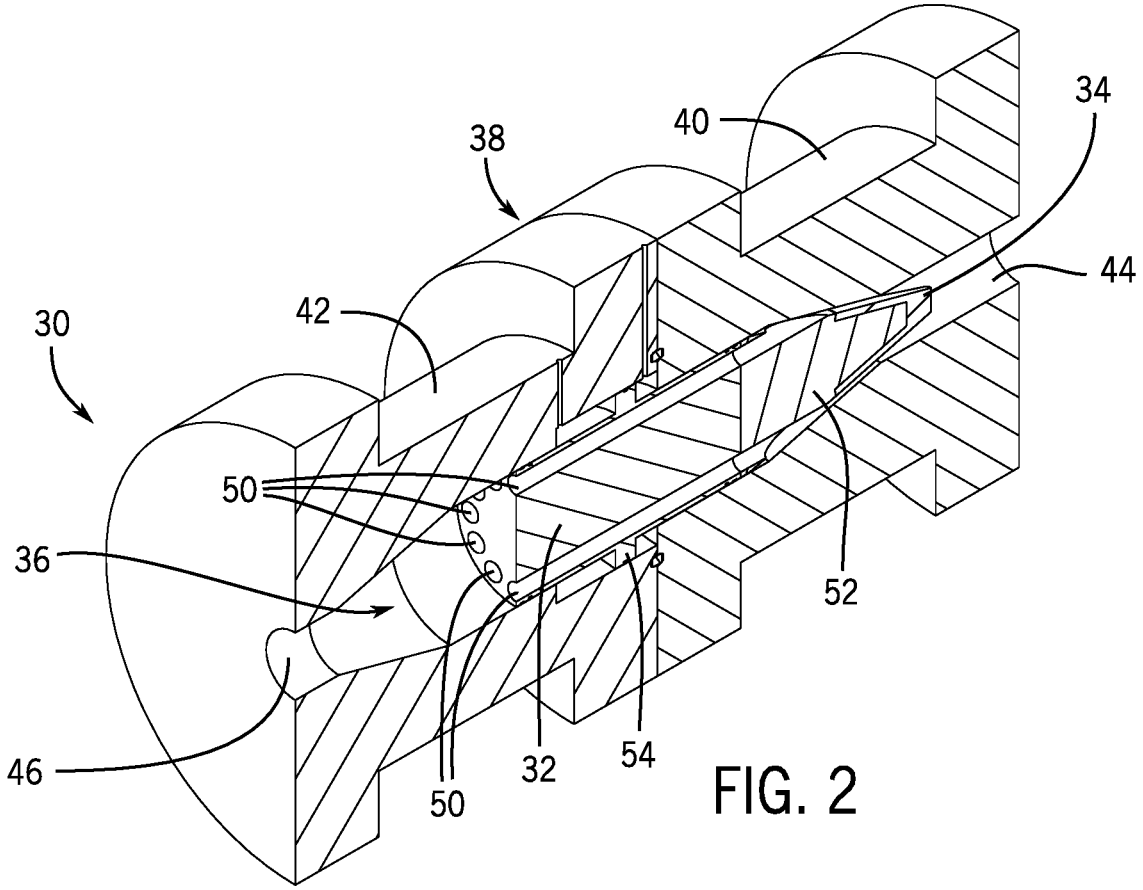
FIG. 2 is a sectioned perspective view of an inline valve having an actuator and seal installed within a flow bore of the valve in accordance with one embodiment.
Figure 3:
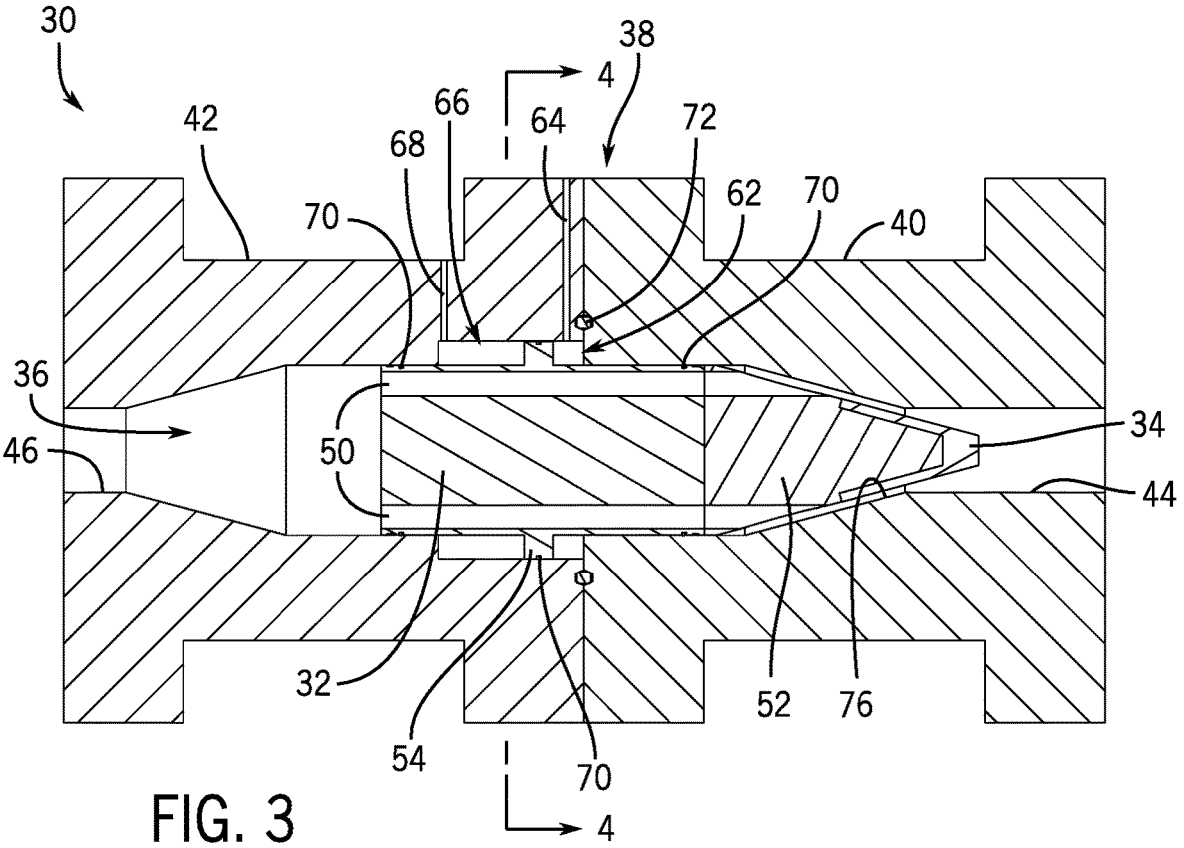
FIG. 3 is an axial cross-section of the valve of FIG. 2 in accordance with one embodiment.

In FIGS. 2 and 3, a frac valve 30 is shown including an actuator 32 and a seal 34 positioned within a bore 36 of a housing 38, which may also be referred to as a conduit 38. In at least some instances, the housing 38 of the frac valve 30 includes multiple bodies (e.g., spools 40 and 42 in FIGS. 2 and 3) to facilitate installation of internal components, such as the actuator 32 and the seal 34, within the bore 36. It will be appreciated that such multiple bodies may be connected in any suitable manner. The spools 40 and 42, for instance, are depicted in FIGS. 2 and 3 as having external connection flanges that can be fastened together, such as by studs and nuts or a clamp. In other instances, however, the housing 38 could be provided in other forms, such as a side- or top-entry valve body with a cover or a single-piece body.

In operation, the actuator 32 moves the seal 34 between open and closed positions to control flow of fracturing fluid between ends 44 and 46 of the bore 36. While fracturing fluid could flow in either direction through the valve 30, in at least some instances the end 44 of the bore 36 is used as an inlet of the valve 30 and the end 46 of the bore 36 is used as an outlet of the valve 30. In some embodiments, including that shown in FIGS. 2 and 3, the seal 34 is carried by a seal carrier 52 that is coupled to the actuator 32.

Figure 4:
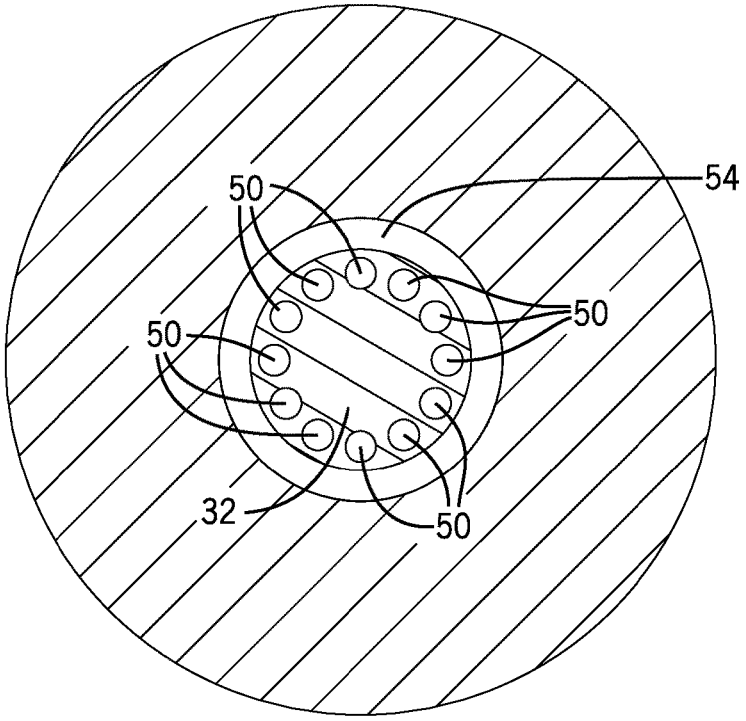
FIG. 4 is a radial cross-section of the valve of FIG. 2 showing the actuator having circumferentially spaced flow-by conduits in accordance with one embodiment.

Flow-by holes 50 extend through the actuator 32 and the seal carrier 52 to facilitate flow of fracturing fluid through the bore 36 of the valve 30 when the seal 34 is in an open position. Although one example of a valve 30 having twelve circumferentially spaced flow-by holes 50 is depicted in FIG. 4, any other suitable number of flow-by holes 50 may be used. The size, shape, and orientation of the flow-by holes 50 may also vary in other embodiments.

In some embodiments, the flow-by holes 50 collectively provide a flow area similar to that of the inlet flow bore. That is, in the case of flow through the valve 30 from end 44 to end 46, the sum of the cross-sectional area of each flow-by hole 50 (measured perpendicular to the flow axis of that hole 50) may be within ten, five, three, two, or one percent of the cross-sectional area of the bore 36 at the end 44 (measured perpendicular to the flow axis of the bore 36 at the end 44), for instance. Further, in one embodiment the sum of the cross-sectional area of each flow-by hole 50 is equal to the cross-sectional area of the bore 36 at the end 44.

Figure 5:
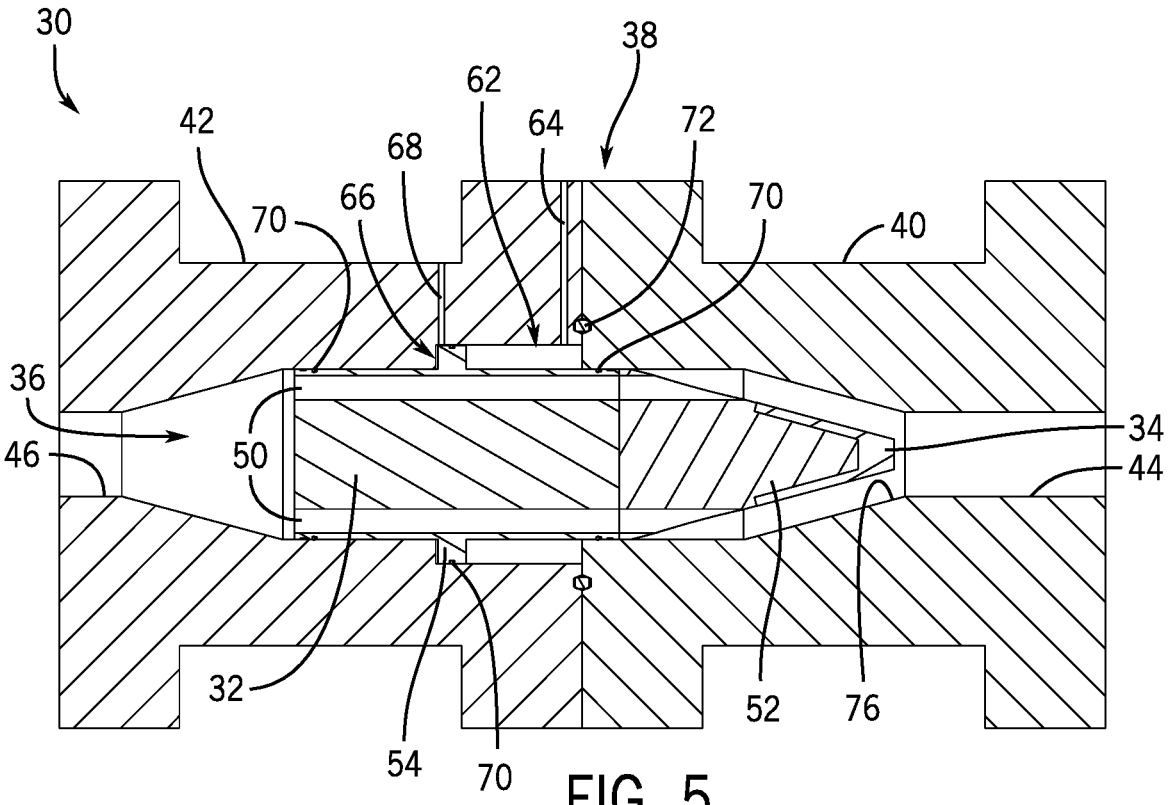
FIG. 5 depicts the actuator and seal of the valve of FIG. 2 in an open position that allows flow through the valve via the flow-by conduits in accordance with one embodiment.

As noted above, the position of the seal 34 is controlled via the actuator 32. In the example of FIGS. 2-4, the actuator 32 is a piston with a piston head 54 (here an annular piston head provided as a circumferential flange) that facilitates hydraulic control of the actuator 32 and the seal 34. Hydraulic control fluid may be routed into a chamber 62 (via port 64) on one side of the piston head 54 to push the actuator 32 in one direction (to the left in FIG. 3) and may be routed into a chamber 66 (via port 68) on an opposite side of the piston head 54 to push the actuator 32 in the opposite direction (to the right in FIG. 3). In this manner, the actuator 32 and the seal 34 may be moved between an open position depicted in FIG. 5 and a closed position depicted in FIG. 6. It will be appreciated that control fluid may be vented from either of chamber 62 or 66 as control fluid is pumped into the other of these chambers. The apparatus can also include any suitable wipers, seals, or gaskets, examples of which include seals 70 and gasket 72.

Figure 6:
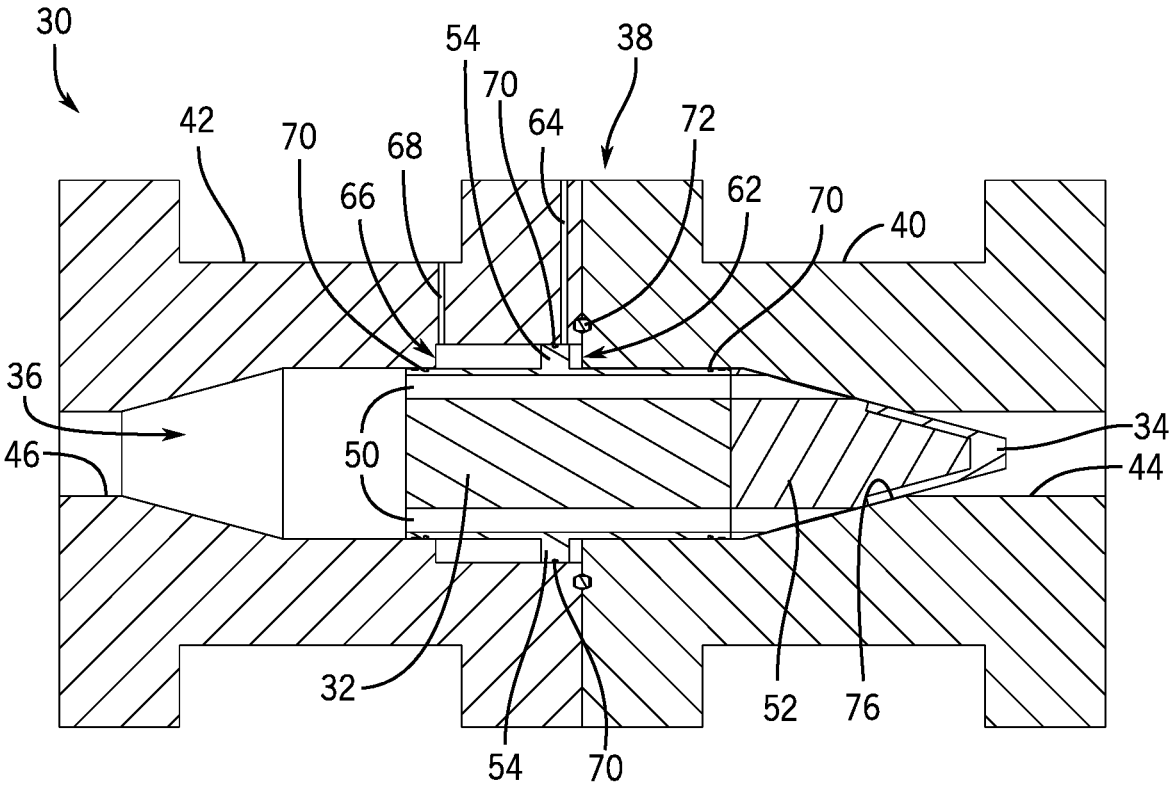
FIG. 6 depicts the actuator and seal of the valve of FIG. 2 in a closed position that blocks flow through the valve in accordance with one embodiment.

The actuator 32, the seal 34, and the seal carrier 52 are shown positioned within the flow path of the valve 30, inline with the ends 44 and 46 along a central axis of the bore 36. The actuator 32, the seal 34, and the seal carrier 52 may be moved axially along the central axis between open and closed positions. With the seal 34 in an open position that allows flow, fracturing fluid may enter the housing 38 through the end 44 of the bore 36, flow past the seal 34 through an opening between the seal 34 and an opposing sealing surface 76 (e.g., a tapered sealing surface along the bore 36), flow through the seal carrier 52 and the actuator 32 via the flow-by holes 50, and exit the housing 38 through the end 46 of the bore 36. In some embodiments, including that of FIGS. 2 and 3, the seal 34 and seal carrier 52 are tapered to facilitate flow of the fracturing fluid from the end 44 of the bore 36 to the flow-by holes 50. The actuator 32 may be used to close the seal 34 against the sealing surface 76, such as shown in FIG. 6, to block flow through the valve 30.

In at least some embodiments, the seal 34 is an elastomer (e.g., rubber) seal that is energized when compressed against the sealing surface 76 by the actuator 32. But the seal 34 may be made of any other suitable material, such as another polymer or metal, in other embodiments. The housing 38, the actuator 32, and the seal carrier 52 may be formed of metal (e.g., carbon or stainless steel) or any other suitable material. Although the seal carrier 52 could be permanently joined to the actuator 32 (e.g., via welding) or formed integrally with the actuator 32 (e.g., as a single forged or cast body), in at least some embodiments, the seal carrier 52 is removable from the actuator 32 to facilitate maintenance. For example, the seal 34 can be molded onto or otherwise affixed to the seal carrier 52 and, when the seal 34 is worn or otherwise damaged, the seal carrier 52 can be removed from the actuator 32 and replaced by a new seal carrier 52 and seal 34. In other instances, the seal 34 may be independently removable (from the seal carrier 52), allowing a replacement seal 34 to be used with the seal carrier 52 and the actuator 32.

Figure 9:
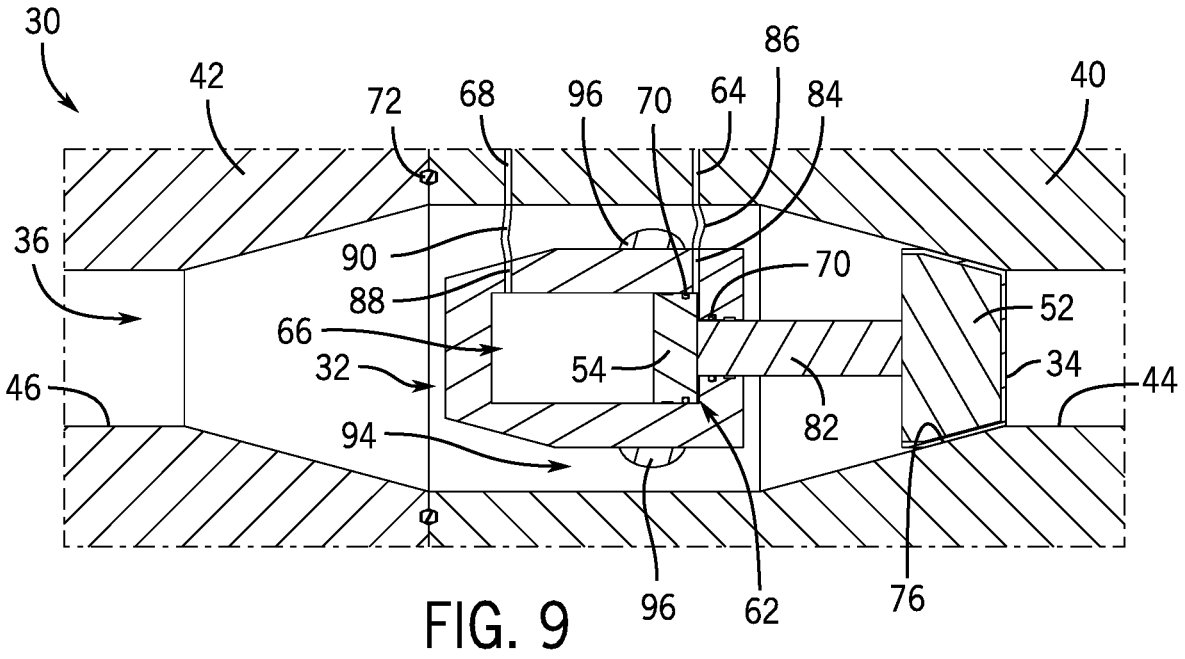
FIG. 9 depicts the seal of the valve of FIG. 7 in a closed position that blocks flow through the valve in accordance with one embodiment.

Another embodiment of a valve 30 is depicted in FIGS. 7-9. In this embodiment, the actuator 32 includes a hydraulic cylinder with an enclosed piston head 54 coupled to the seal carrier 52 and seal 34 by a piston rod 82. Like the embodiment of FIGS. 2 and 3, the seal 34 (e.g., an elastomer seal) may be moved between an open position (FIG. 7) and a closed position (FIG. 9) to allow or block flow in either direction by routing control fluid (e.g., hydraulic control oil) into chamber 62 or chamber 66. The cylinder body of the actuator 32 in FIG. 7 includes a port 84 coupled to receive control fluid from the port 64 via control line 86, as well as a port 88 coupled to receive control fluid from the port 68 via control line 90. Although depicted as a hydraulic actuator, the actuator 32 may take other forms, such as an electric actuator or pneumatic actuator, in different embodiments.

In the presently depicted embodiment, the actuator 32 is positioned within the bore 36 inline with the seal 34, the seal carrier 52, and the flow path through the valve 30 such that fracturing fluid flows through a flow-by area 94 around the exterior of the actuator 32 when the seal 34 is in an open position (e.g., as shown in FIG. 7). The actuator 32 is shown in FIG. 8 as having a round exterior surface without flow-by conduits, but the actuator 32 could have flow-by conduits (e.g., a fluted body with exterior flow-by slots) in other examples. In at least some instances, the cross-sectional area of the flow-by area 94 is within ten, five, three, two, or one percent, or is equal to, the cross-sectional area of the bore 36 at the end 44 (each measured in a plane perpendicular to the direction of mass flow). The actuator 32 may be secured at a location within the bore 36 in any suitable manner, such as with radially extending legs 96 that may be received in mating recesses in the spool 40 or welded in place.

Figure 10:
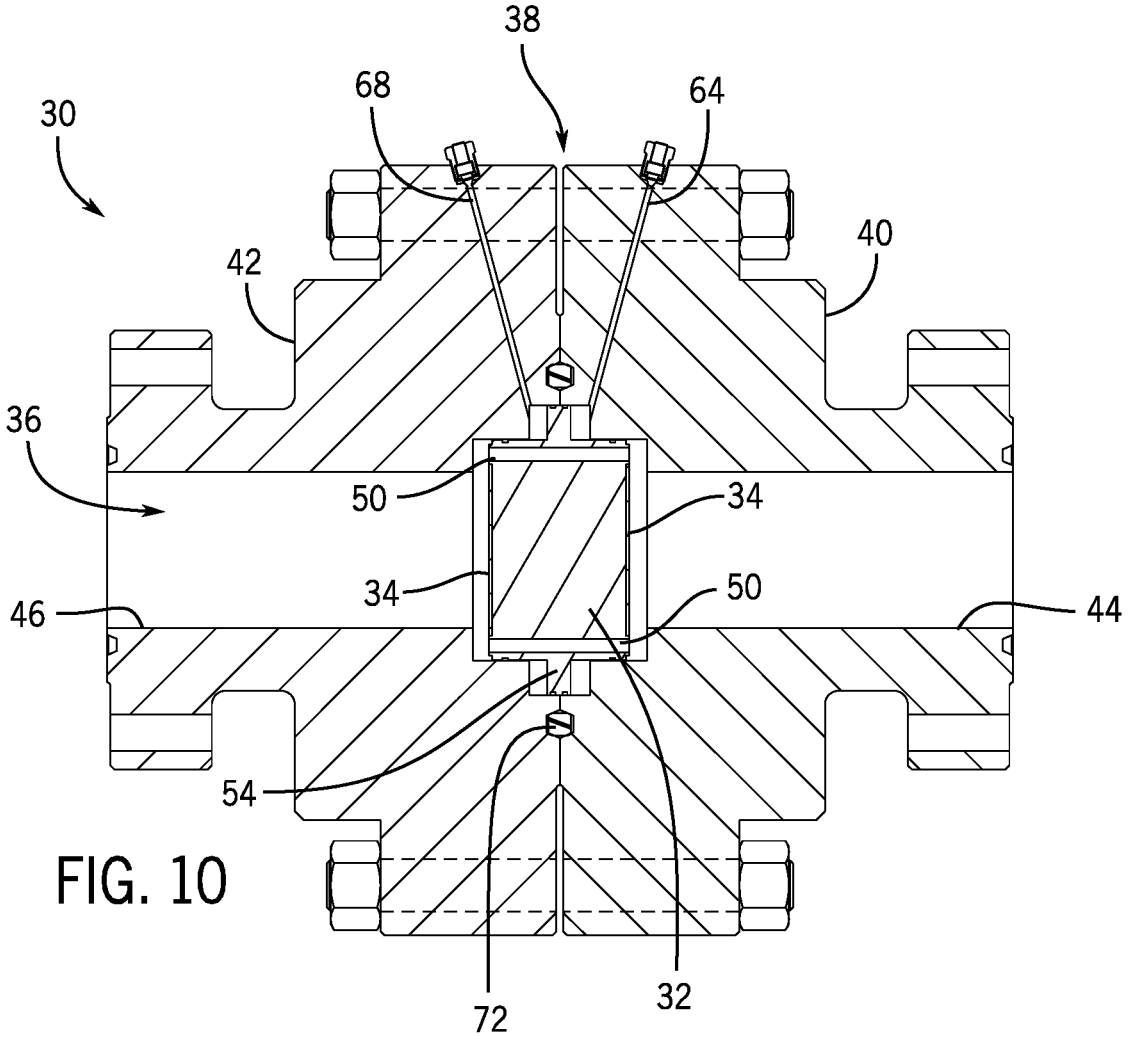
FIG. 10 depicts an inline frac valve having seals on opposite faces of an actuator installed within a flow bore of the valve, with the actuator and seals in an open position that allows flow through the valve via flow-by conduits in the actuator, in accordance with one embodiment.
Figure 11:
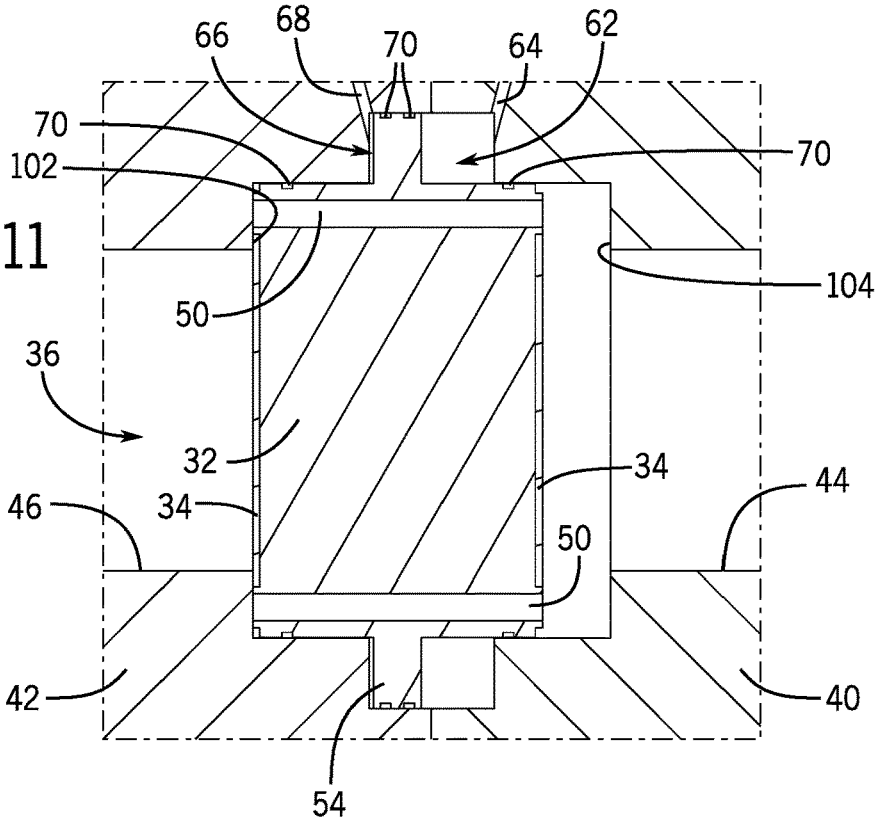
FIG. 11 depicts the valve of FIG. 10 with one of the face seals moved to a closed position that blocks flow through the valve in accordance with one embodiment.
Figure 12:
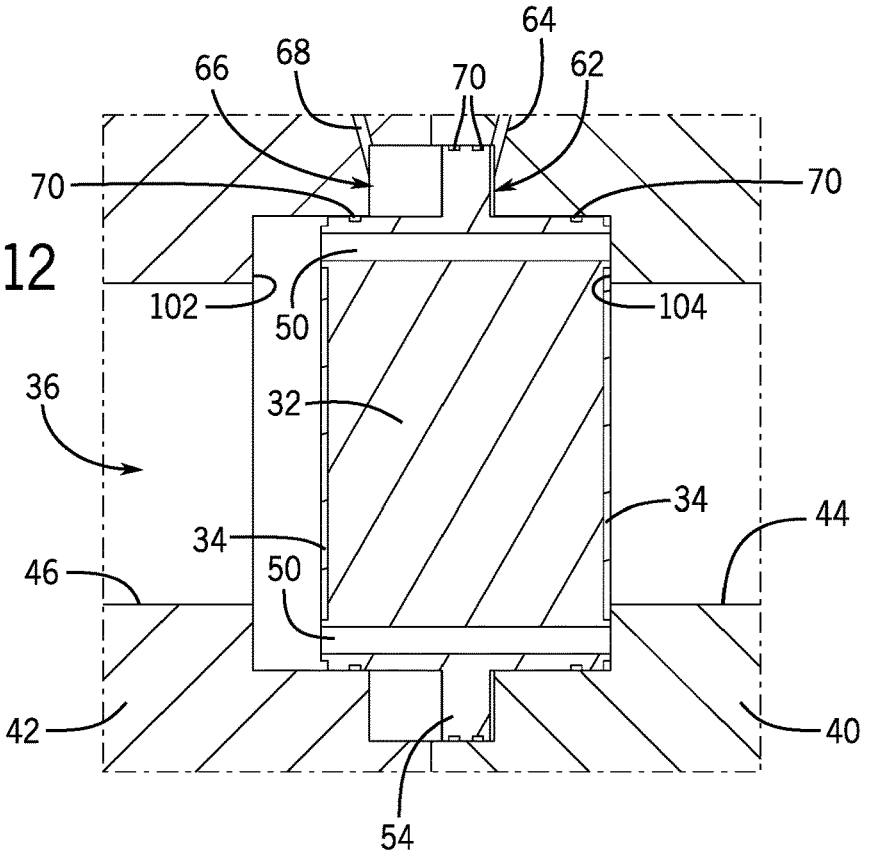
FIG. 12 depicts the valve of FIGS. 10 and 11 with the other of the face seals moved to a closed position that blocks flow through the valve in accordance with one embodiment.

In some embodiments, the actuator 32 itself carries the seal 34 without a separate seal carrier 52. Some examples of such embodiments are depicted in FIGS. 10-16. In FIGS. 10-12, for instance, the valve 30 is shown with an actuator 32 that carries two seals 34 and is installed within the bore 36 inline with the flow path. The actuator 32, which includes flow-by holes 50, can be moved between open and closed positions by injecting control fluid into chambers 62 and 66 through ports 64 and 68.

The two seals 34 in FIGS. 10-12 are face seals carried on opposite sides of the actuator that are transverse to the bore 36. This arrangement allows bidirectional sealing in the valve 30, in which the actuator 32 can be moved in either of two opposing axial directions to block flow through the bore 36. The actuator 32 and the seals 34 are shown in an open position in FIG. 10 to allow fracturing fluid to flow through the bore 36 via the flow-by holes 50. A control fluid may be routed into the chamber 62 to drive the actuator 32 to the closed position depicted in FIG. 11, in which the seal 34 on the left side of the actuator 32 is compressed against an opposing sealing surface 102 to block flow though the bore 36 (by isolating the flow-by holes 50 from the end 46 of the bore 36). Likewise, a control fluid may be routed into the chamber 66 to drive the actuator 32 in an opposite direction to the closed position depicted in FIG. 12, in which the seal 34 on the right side of the actuator 32 is compressed against an opposing sealing surface 104 to block flow through the bore 36 (by isolating the flow-by holes 50 from the end 44 of the bore 36). The pressures in chambers 62 and 66 may be equalized to hold the actuator 32 and the seals 34 in an open position to allow flow. The sealing surfaces 102 and 104 may be stop shoulders of spools 40 and 42, as shown in FIGS. 10-12, or any other suitable surfaces.

As discussed above, the number, size, shape, and orientation of the flow-by holes 50 in the actuator 32 may vary between embodiments. The flow-by holes 50 (e.g., twelve or sixteen holes) can be spaced circumferentially about the actuator 32 radially outward of the seals 34. In some instances, the valve 30 can be constructed such that the flow-by holes 50 collectively provide a flow-by area that is within ten, five, three, two, or one percent, or is equal to, the cross-sectional area of the bore 36 at the end 44 or 46 of the bore 36 upstream of the actuator 32.

Figure 13:
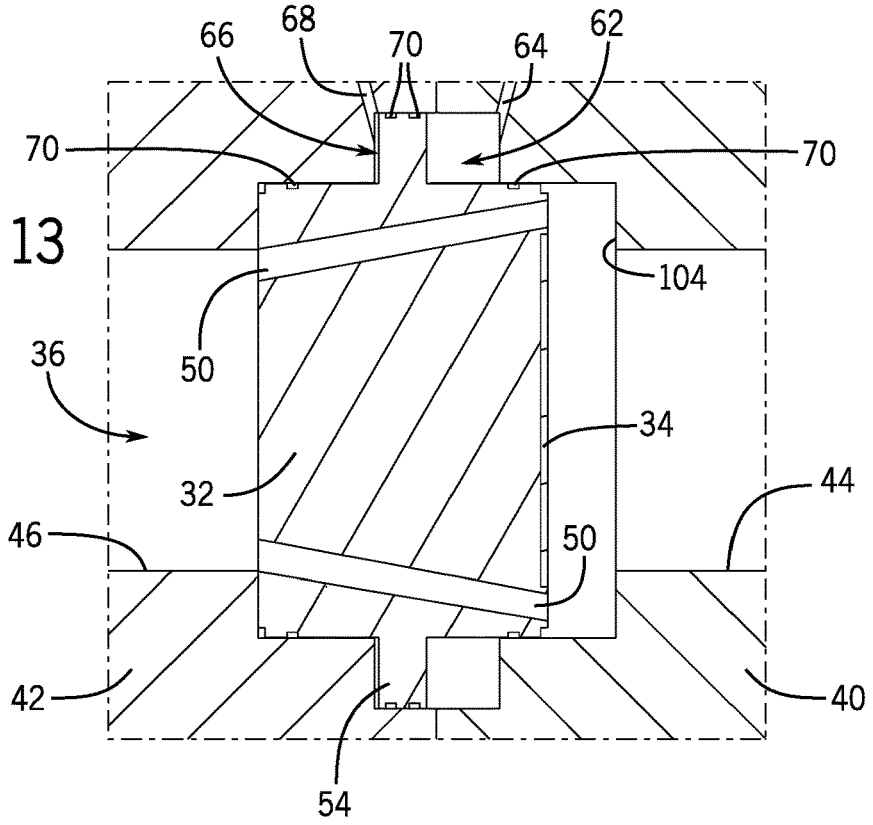
FIG. 13 depicts an inline frac valve like that of FIG. 10 but with a single face seal on the actuator and angled flow-by conduits in accordance with one embodiment.
Figure 14:
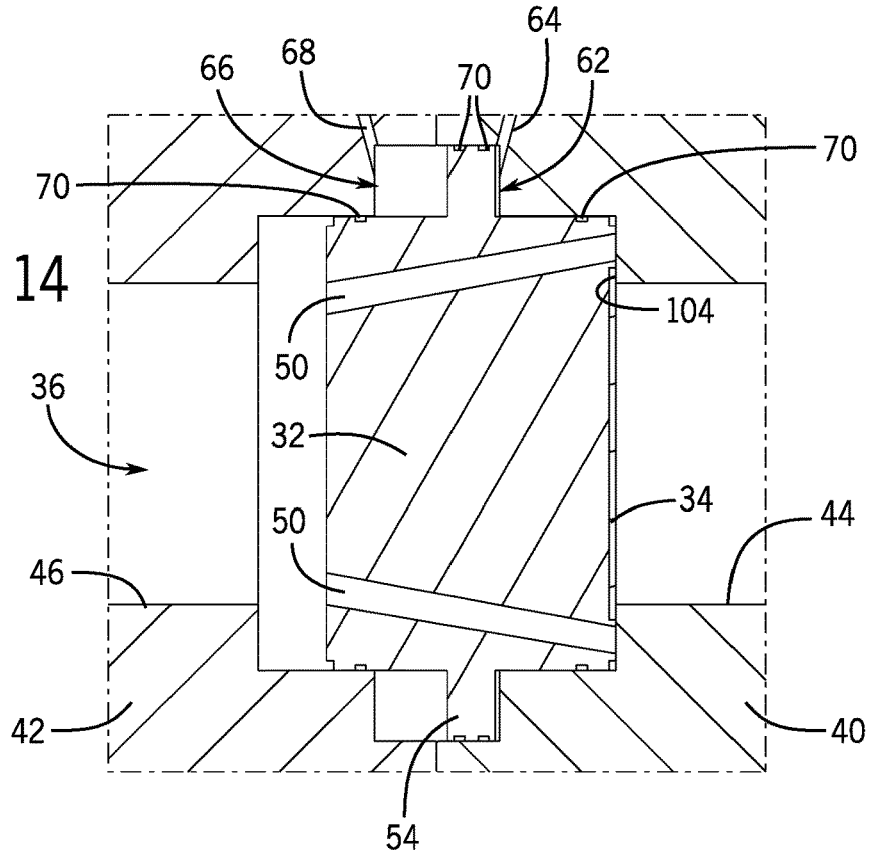
FIG. 14 depicts the valve of FIG. 13 with the actuator and face seal in a closed position that blocks flow through the valve in accordance with one embodiment.
Figure 15:
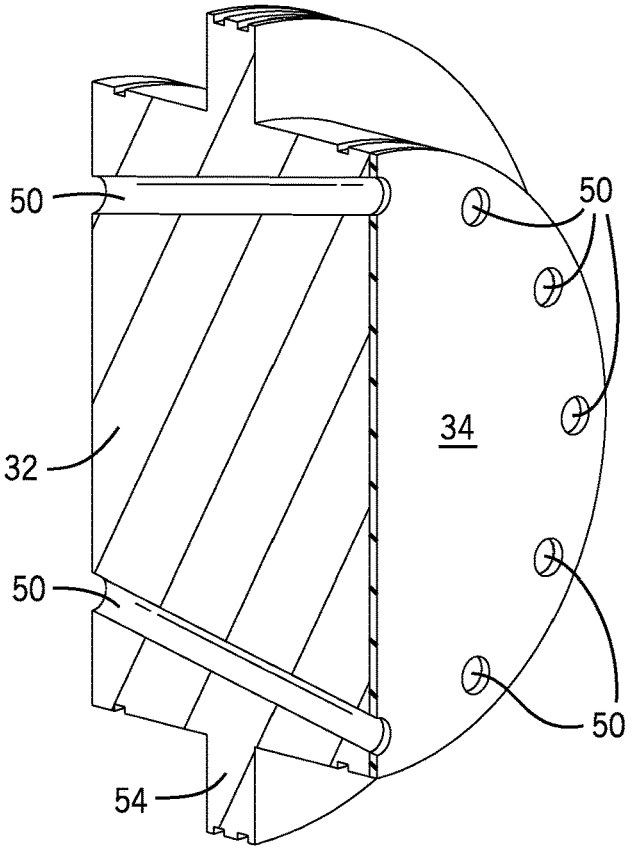
FIGS. 15 and 16 depict additional seal configurations for the actuator of FIG. 13 in accordance with some embodiments.
Figure 16:
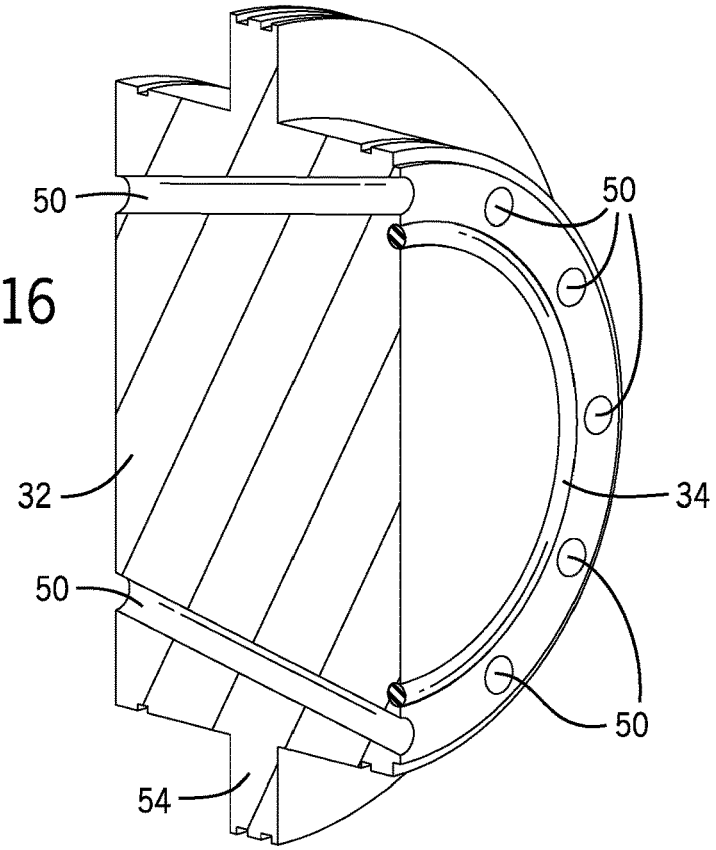

As shown in FIGS. 13 and 14, the inline actuator 32 carries a seal 34 on just one side transverse to the bore 36. This arrangement provides unidirectional sealing, in which the actuator 32 is closed in a single direction to block flow through the valve 30. More specifically, the actuator 32 can be moved between an open position (FIG. 13) and a closed position (FIG. 14), in which the seal 34 seals against the opposing sealing surface 104 to block flow through the bore 36. While the actuator 32 can have straight flow-by holes 50 (like those shown in FIGS. 3 and 10), the flow-by holes 50 in FIGS. 13 and 14 are instead angled with respect to the axis of the bore 36.

The seal 34 can be made of any suitable material. In some embodiments, the seal 34 is an elastomer, thermoplastic, or other non-metal seal. In some other embodiments, the seal 34 may be a metal seal. Further, a combination of metal and non-metal seals 34 may be used in some instances. The seal 34 may also have any suitable shape. In FIGS. 10-14, for example, the seal 34 can be shaped as a disc positioned radially inward of the flow-by holes 50. The seal 34 can be inset within a recess of the actuator 32, such as also shown in FIGS. 10-14. In other instances, such as that depicted in FIG. 15, the seal 34 extends radially beyond the flow-by holes 50. In one embodiment, the seal 34 is a layer (e.g., an elastomer layer) formed on or otherwise affixed to a transverse side of the actuator 32 and the flow-by holes 50 extend through the seal layer. In another embodiment generally depicted in FIG. 16, the seal 34 is an annular seal received in a groove in a transverse face of the actuator 32.

An additional embodiment of a valve 30 is depicted in FIGS. 17-20 in the form of an actuatable plug assembly 112 installed within a bore 114 of the wellhead 14, which is shown having a lower spool 116 (e.g., a casing head) with side ports 118 and an upper spool 120. The plug assembly 112 includes a plug body 124 (which may also be referred to as a housing) that houses the actuator 32, the seal 34, and the seal carrier 52 (e.g., a poppet). Movement of the actuator 32 can be hydraulically controlled via ports 64, 68, 84, and 88, as described above, and the seal carrier 52 is attached to move synchronously with the actuator 32 to open (FIG. 18) or close (FIG. 20) the seal 34 against a sealing surface 76 of the plug body 124. A retainer 126 retains the actuator 32 in the plug body 124. In some instances, including that shown in FIGS. 17 and 18, the retainer 126 is threaded into the plug body 124 and set screw 128 inhibits further rotation of the retainer 126 in operation.

The plug assembly 112 may be installed within the wellhead 14 in any suitable manner. As one example, in FIGS. 17 and 18 the plug assembly 112 is landed on a landing shoulder 132 of the spool 116 and is retained with lock screws 134. As presently depicted, the lock screws 134 extend into the bore 114 and have tapered ends that drive an energizing ring 136 downward to energize an annular seal 138 between the plug body 124 and the spool 116.

In operation, the seal 34 (e.g., an elastomer seal or other polymeric seal, or a metal seal) moves between open and closed positions to control flow between a central bore 142 and a port 144 in the plug body 124. While a single port 144 is presently shown, the plug body 124 may include additional ports 144 in some instances. As generally depicted in FIG. 19, the seal carrier 52 is a fluted poppet that is installed within the flow path through the valve 30 and has flow-by slots 148 in its exterior surface. When the seal 34 is opened, fluid can flow through an opening between the seal 34 and the sealing surface 76 and through the flow-by slots 148, thus allowing fluid to pass between the bore 142 and the port 144. The seal 34 can be closed against the sealing surface 76 to block flow.

Like the flow-by holes 50 discussed above, the number, size, shape, and orientation of the flow-by slots 148 in the seal carrier 52 may vary. The flow-by slots 148 may be spaced circumferentially about the exterior of the seal carrier 52. In some instances, these flow-by slots 148 may collectively provide a flow-by area that is within ten, five, three, two, or one percent, or is equal to, the cross-sectional area of the bore 142 at another location, such as at a cylindrical portion of the bore 142 below the tapered sealing surface 76 in FIG. 18.

Figure 17:
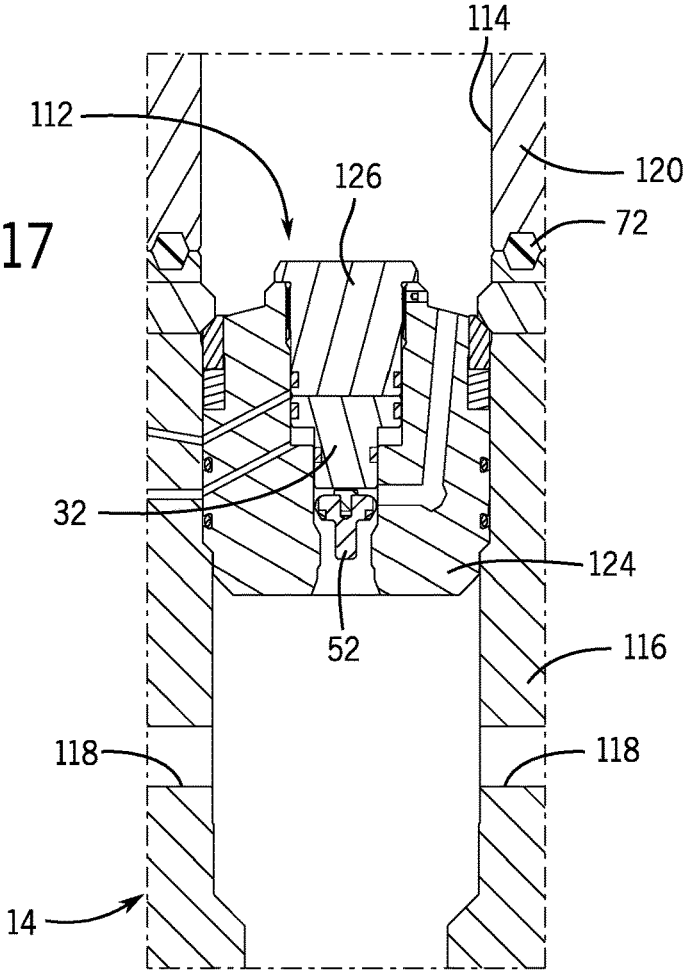
FIG. 17 depicts a valve as an actuatable plug assembly installed within a bore of a wellhead in accordance with one embodiment.
Figure 18:
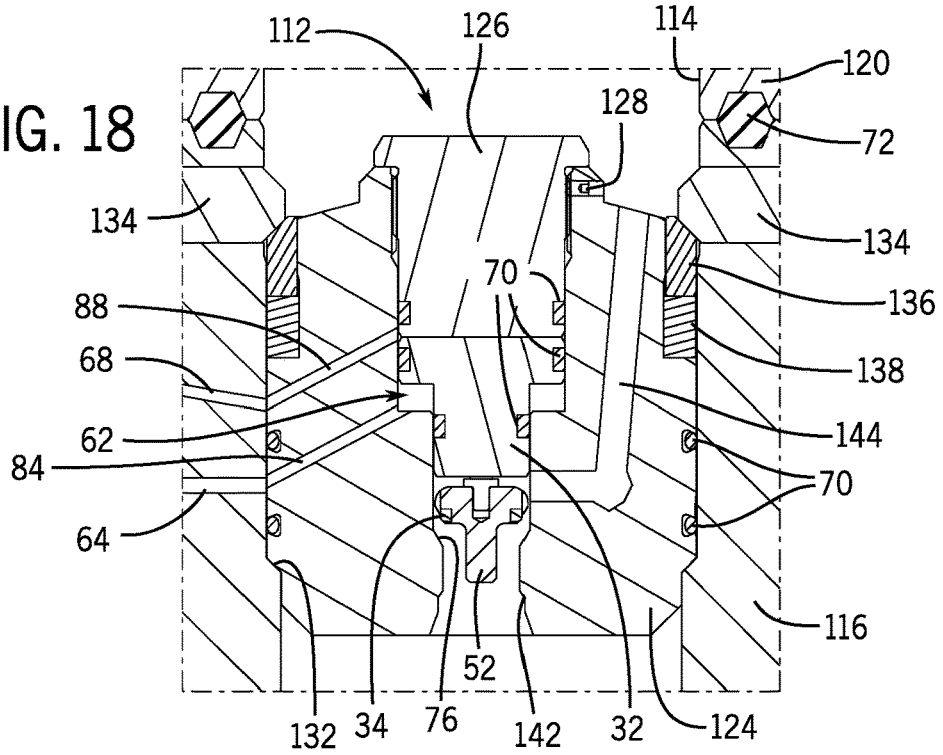
FIG. 18 is a detail view of the actuatable plug assembly of FIG. 17 and shows an actuator, seal carrier, and seal in an open position that allows flow through the assembly in accordance with one embodiment.

While the actuatable plug assembly 112 is shown installed within a wellhead 14 in FIGS. 17, 18, and 20, it will be appreciated that the plug assembly 112 could be installed in other locations, such as within spools 40 and 42, a fracturing tree (e.g., as a lower or upper master valve), a manifold, or a flowline. Similarly, the valves 30 depicted in FIGS. 2-16 can be used in a fracturing tree, in a manifold, in a flowline, as a plug within a wellhead 14, or in any other suitable location. In some embodiments, the presently disclosed inline valves may be used in place of gate valves in fracturing trees or fracturing manifolds. In contrast to gate valves that are regularly greased during a fracturing operation to displace proppant and debris from gate cavities within the valve bodies, the presently disclosed inline valves could be used with little or no greasing during a fracturing operation.

The actuator 32 of the various embodiments described above can take any suitable form, such as a hydraulic actuator, a manual actuator, an electric actuator, or a pneumatic actuator, or combinations thereof. In at least some embodiments, the actuator 32 of a valve 30 is an internal actuator positioned within the flow path through the valve 30, actuation is within the valve body, and the valve 30 does not have an external actuator for controlling flow through the valve.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A fracturing apparatus comprising:

a frac valve to control flow of fracturing fluid through the frac valve, the frac valve comprising:

a housing having a bore to convey the fracturing fluid, wherein the bore has a central axis extending from an inlet of the housing to an outlet of the housing;

a seal disposed within the bore; and an actuator coupled to control movement of the seal, wherein the actuator is disposed within the bore so as to move the seal between a closed position in which the seal blocks fracturing fluid flow through the bore and an open position that allows fracturing fluid flow through the bore, the actuator includes flow-by conduits that permit fracturing fluid flow past the actuator when the seal is in the open position, and the actuator is positioned inline with the inlet of the housing and the outlet of the housing such that the central axis extending from the inlet of the housing to the outlet of the housing intersects the actuator.

2. The fracturing apparatus of claim 1, wherein the actuator is disposed within the bore so as to move axially along the central axis when moving the seal between the closed position and the open position.

3. The fracturing apparatus of claim 1, wherein the seal includes an elastomer seal.

4. The fracturing apparatus of claim 1, wherein the frac valve does not have an external actuator.

5. The fracturing apparatus of claim 1, wherein the actuator includes a piston disposed within the bore.

6. The fracturing apparatus of claim 1, wherein the frac valve includes a tapered sealing surface along the bore and the seal is closed against the tapered sealing surface to block fracturing fluid flow through the bore when the seal is in the closed position.

7. The fracturing apparatus of claim 6, wherein the seal includes a tapered outer surface oriented to seal against the tapered sealing surface of the frac valve when the seal is in the closed position.

8. The fracturing apparatus of claim 1, wherein the flow-by conduits include flow-by holes extending through the actuator.

9. The fracturing apparatus of claim 1, comprising a seal carrier that carries the seal, wherein the actuator is coupled to the seal carrier to control movement of the seal via the seal carrier.

10. The fracturing apparatus of claim 1, wherein the seal is carried by the actuator.

11. The fracturing apparatus of claim 10, wherein the seal is positioned on a side of the actuator that is transverse to the bore of the housing.

12. The fracturing apparatus of claim 11, wherein the frac valve includes an additional seal positioned on an additional side of the actuator, and the additional side is also transverse to the bore of the housing.

13. The fracturing apparatus of claim 1, comprising a fracturing tree having the frac valve.

14. The fracturing apparatus of claim 1, comprising a wellhead, wherein the housing of the frac valve is installed within a bore of the wellhead.

15. The fracturing apparatus of claim 14, wherein the housing of the frac valve is landed on a shoulder of the wellhead.

16. A method of controlling flow of fracturing fluid in a fracturing apparatus, the method comprising:

routing the fracturing fluid into a frac valve of the fracturing apparatus, the frac valve including: a housing having a bore to convey the fracturing fluid, wherein the bore has a central axis extending from an inlet of the housing to an outlet of the housing; a seal disposed within the bore; and an actuator coupled to control movement of the seal, wherein the actuator is disposed within the bore so as to move the seal between a closed position in which the seal blocks fracturing fluid flow through the bore and an open position that allows fracturing fluid flow through the bore, the actuator includes flow-by conduits that permit fracturing fluid flow past the actuator when the seal is in the open position, and the actuator is positioned inline with the inlet of the housing and the outlet of the housing such that the central axis extending from the inlet of the housing to the outlet of the housing intersects the actuator; and closing the frac valve to block fracturing fluid flow through the frac valve, wherein the seal includes an elastomer seal and closing the frac valve includes operating the actuator to compress the elastomer seal against an opposing surface to block fracturing fluid flow through the frac valve.

17. The method of claim 16, comprising opening the frac valve to permit fracturing fluid flow through the frac valve, wherein opening the frac valve includes moving the elastomer seal away from the opposing surface to permit fracturing fluid flow through the frac valve via an opening between the elastomer seal and the opposing surface.

18. The method of claim 16, wherein the actuator is a hydraulic actuator or an electric actuator.

19. The method of claim 16, wherein operating the actuator to compress the elastomer seal against the opposing surface includes operating a piston disposed within the bore to compress the elastomer seal against the opposing surface.

* * * * *